United States Patent [19]

Laughlin

[11] 4,184,798

[45] Jan. 22, 1980

[54] WORKPIECE ROTATING AND FEEDING APPARATUS

[75] Inventor: John R. Laughlin, Brecksville, Ohio

[73] Assignee: Park-Ohio Industries, Inc., Cleveland, Ohio

[21] Appl. No.: 871,329

[22] Filed: Jan. 23, 1978

[51] Int. Cl.[2] ..... B23Q 5/22

[52] U.S. Cl. ..... 414/16; 219/10.67; 414/17; 414/18

[58] Field of Search ..... 214/1.3, 1.4, 1.5, 1 BB, 214/338; 219/10.67, 10.73, 10.69; 414/16, 17, 18, 749, 431; 29/37 A

[56] References Cited

U.S. PATENT DOCUMENTS

| | | | |
|---|---|---|---|
| 767,078 | 8/1904 | Mueller | 214/338 |
| 2,247,864 | 7/1941 | Tiedemann | 214/338 |
| 2,376,476 | 5/1945 | Chatelain | 29/37 A |
| 2,504,198 | 4/1950 | Jagen | 219/10.69 X |
| 3,384,730 | 5/1968 | Easley | 219/10.73 |

FOREIGN PATENT DOCUMENTS

| | | | |
|---|---|---|---|
| 512076 | 8/1939 | United Kingdom | 29/37 A |

*Primary Examiner*—Stephen G. Kunin
*Assistant Examiner*—George Abraham
*Attorney, Agent, or Firm*—Meyer, Tilberry & Body

[57] ABSTRACT

Apparatus is provided for simultaneously rotating and axially feeding an elongated workpiece past an induction heating inductor. The apparatus includes a collet having a passageway therethrough defined in part by radially displaceable fingers normally providing an opening of a diameter smaller than the smallest diameter of the workpiece. A workpiece is pushed through the collet and the collet is simultaneously rotated for the fingers to rotate the workpiece as the latter slides axially along the fingers.

8 Claims, 6 Drawing Figures

WORKPIECE ROTATING AND FEEDING APPARATUS

DISCLOSURE

The present invention relates to the art of workpiece feeding and, more particularly, to the rotating and axial feeding of cylindrical workpieces along a work path.

The present invention finds particular utility in conjunction with rotating and axial feeding of cylindrical metal workpieces past an induction heating inductor, and the invention will be described in detail hereinafter wtih regard to such use. However, it will be appreciated that the invention is applicable to the rotating and axial feeding of workpieces other than in conjunction with induction heating equipment.

It is of course well known in the heat treating field to inductively heat an elongated cylindrical workpiece by simultaneously rotating and axially feeding the workpiece through an inductor coil of the induction heating equipment. Such rotation and axial feeding of workpieces has, for example, been achieved heretofore through the use of three rollers spaced about an axis to engage a cylindrical workpiece therebetween so that rotation of the rollers imparts rotation and axial displacement to the workpiece. While such an arrangement works satisfactorily in connection with the feeding of cylindrical workpieces which are of uniform diameter along the length thereof, problems are encountered in connection with the feeding of workpieces having different diameters and/or workpieces having varying cross-sectional configurations or diameters along the length thereof. In this respect, the rollers in such roller type feed arrangements are radially fixed with respect to the axis of a workpiece. Therefore, the rollers cannot accommodate a workpiece having a diameter, or a diameter change along the length thereof, which would provide for the workpiece or a portion thereof to be diametrically smaller or larger than that which the roller surfaces are designed to engage. Accordingly, it has been necessary in connection with such roller feed arrangements to change the roller diameter and/or radially reposition the rollers for each different diameter workpiece to be handled. Such a requirement is economically undesirable both from the standpoint of the cost of equipment and the time required to modify feeding apparatus provided in conjunction with the inductor coil of induction heating equipment which otherwise can accommodate different size workpieces. Moreover, while roller type feed mechanisms can be designed to handle workpieces having a given diameter along the length thereof, it remains that such roller type feed mechanisms cannot handle a workpiece having different diameters along the length thereof. For this reason too, induction heating equipment with which such roller type feed mechanisms are employed is limited in use by such prior feed mechanism capabilities.

In accordance with the present invention, apparatus for simultaneously rotating and axially feeding workpieces is provided which advantageously overcomes the foregoing limitations with respect to feeding different diameter workpieces and workpieces having different diameters along the lengths thereof. In this respect, the feed apparatus according to the present invention provides radially variable workpiece engaging surfaces which frictionally engage the workpiece and which are rotated to impart rotation to the workpiece. Further, the workpiece engaging surfaces slidably support the workpiece so that the latter can be axially displaced relative to the workpiece engaging surfaces, such as by a push rod, simultaneous with the rotation thereof.

The radially variable workpiece engaging surfaces radially expand and contract to accommodate different workpiece diameters, and such expansion and contraction can take place during axial movement of a workpiece therebetween, thus to accommodate a workpiece having varying diameters along the lengths thereof. Accordingly, it will be appreciated that a given feed mechanism in accordance with the present invention can handle cylindrical workpieces of different diameters and workpieces having different diameters along the lengths thereof. Further, as will become more apparent hereinafter, the feed apparatus of the present invention can handle workpieces having non-circular cross-sectional configurations along the lengths thereof or along portions of the lengths thereof, thus, further increasing the versatility of the feed mechanism of the present invention. In addition to such improved versatility, the workpiece feeding apparatus of the present invention enables optimizing the use of induction heating equipment with which the feeding apparatus is employed.

It is therefore an outstanding object of the present invention to provide improved apparatus for simultaneously rotating and axially feeding a workpiece along a work path.

Another object is the provision of apparatus of the foregoing character capable of handling elongated workpieces having different cross-sectional configurations and/or dimensions along the length thereof or along a portion of the length thereof.

A further object is the provision of apparatus of the foregoing character which is economical to produce and which is efficient and versatile in use.

The foregoing objects, and others, will in part be obvious and in part pointed out more fully hereinafter in conjunction with the written description of a preferred embodiment shown in the accompanying drawings in which.

Figure 1:
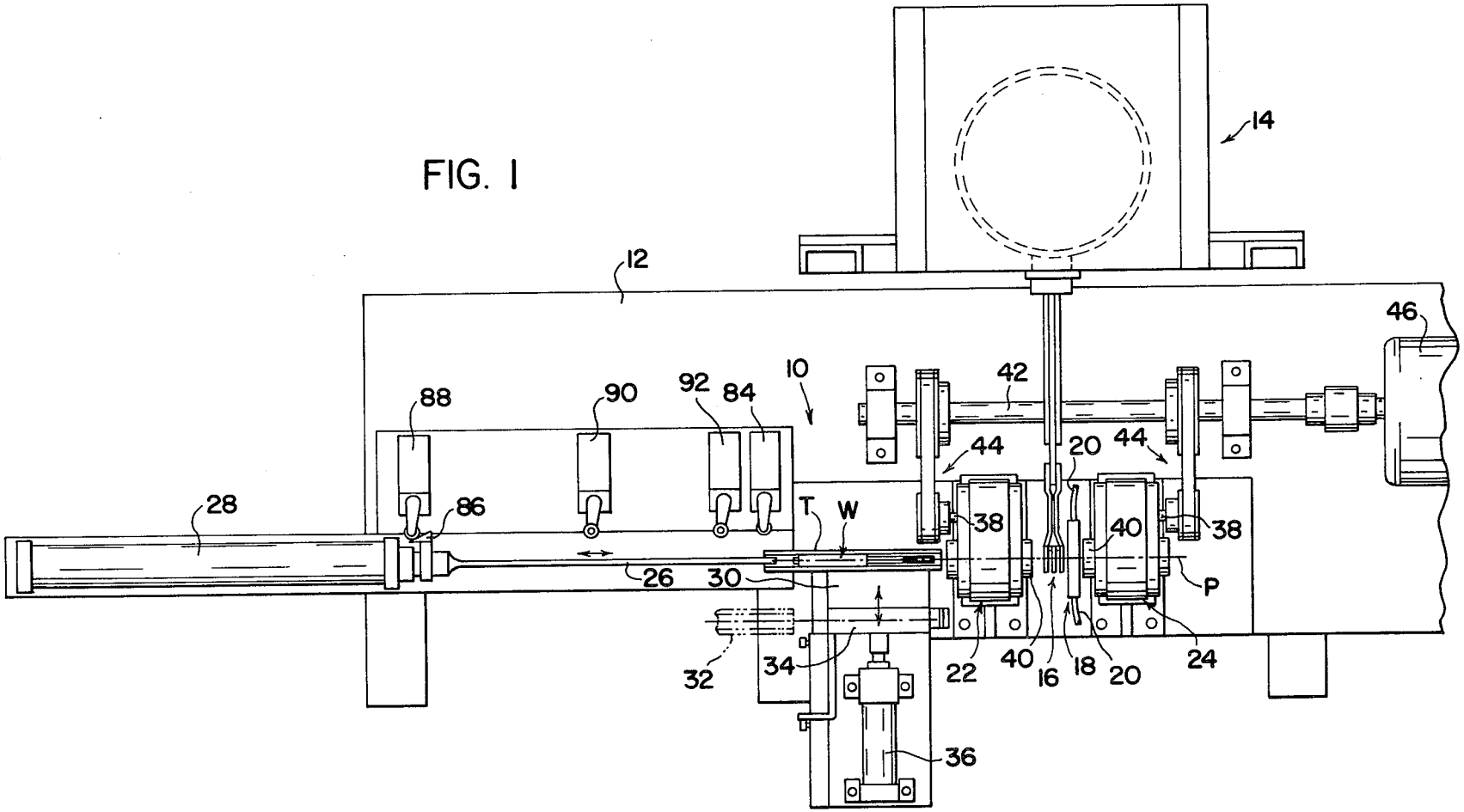
FIG. 1 is a plan view illustrating feeding apparatus in accordance with the present invention in conjunction with induction heating equipment.
Figure 2:
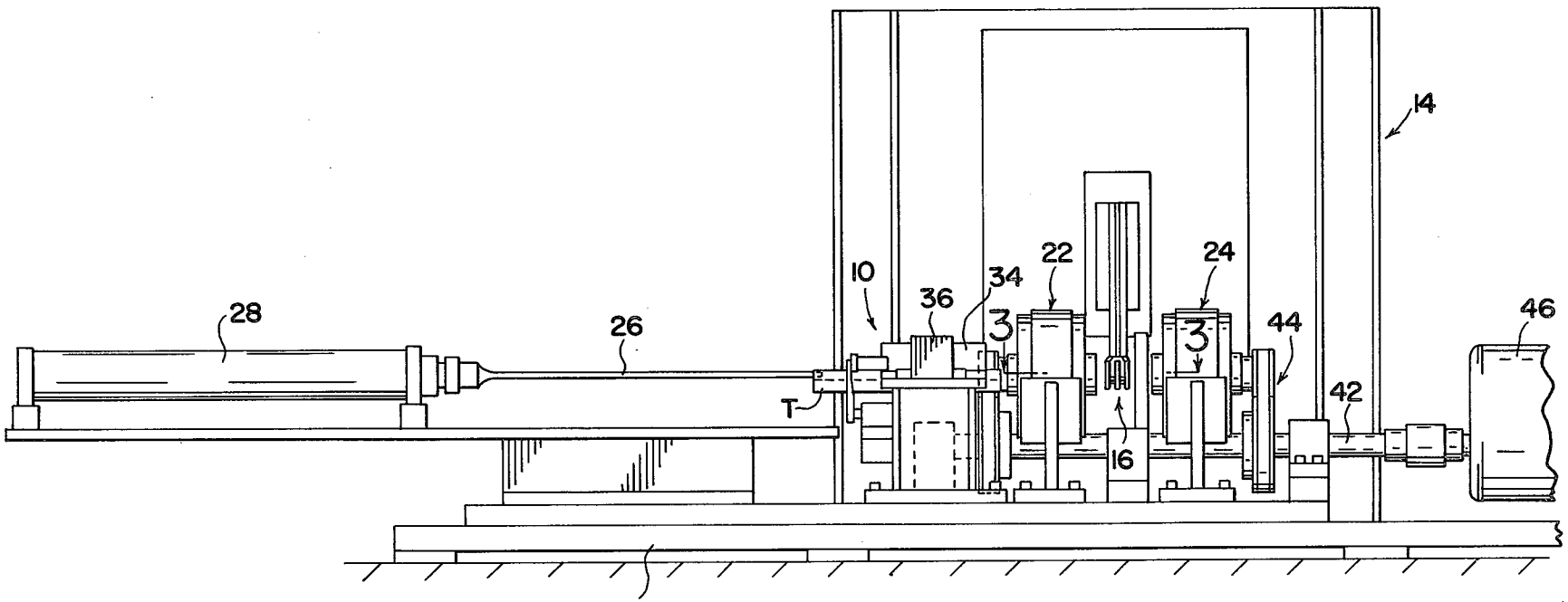
FIG. 2 is a front elevation view of the feeding apparatus and induction heating equipment shown in FIG. 1.
Figure 3:
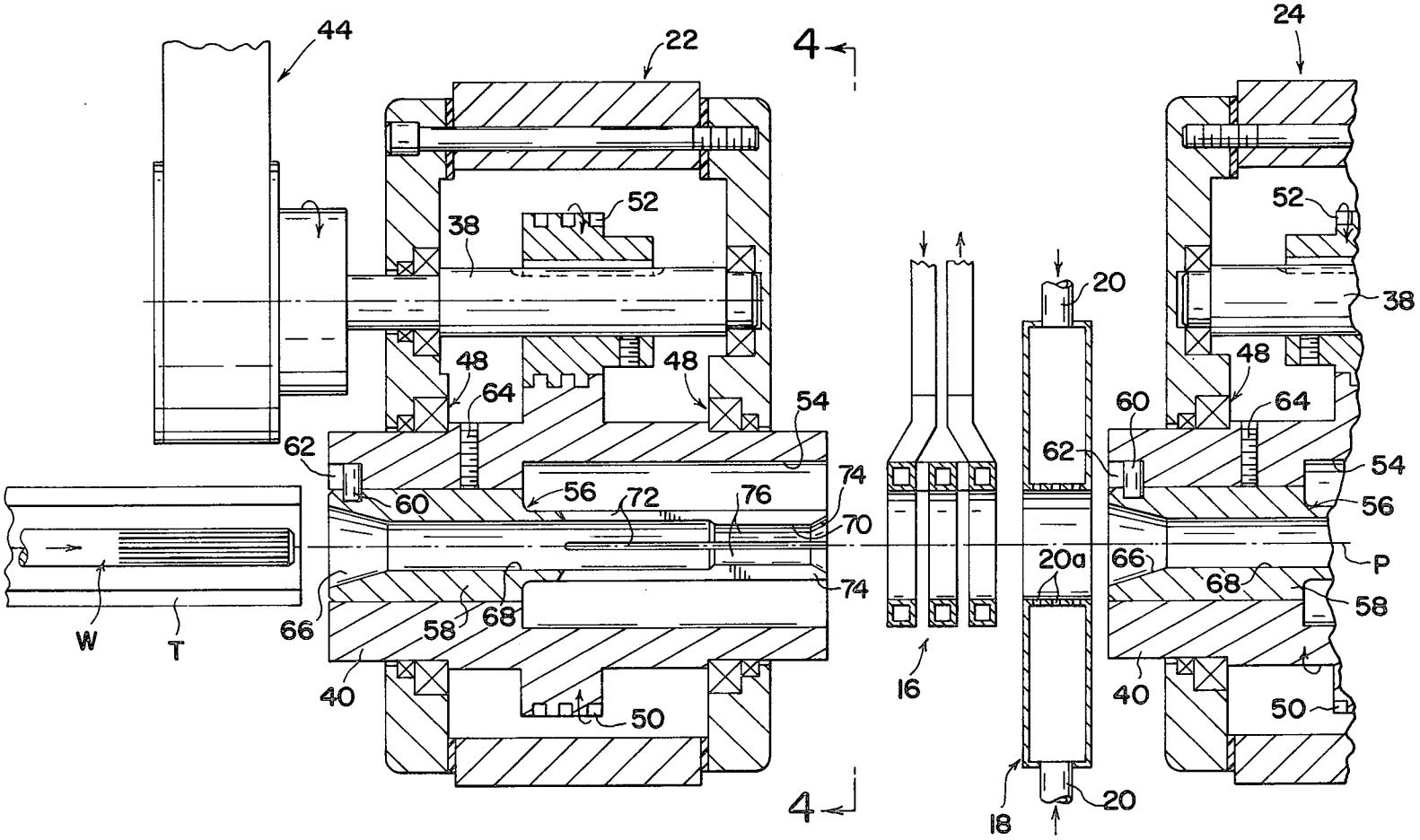
FIG. 3 is a plan view, in section of the feeding apparatus taken along line 3—3 in FIG. 2.

With regard now in particular to the drawings wherein the showings are for the purpose of illustrating a preferred embodiment of the invention only and not for the purpose of limiting the invention, FIGS. 1 and 2 illustrate workpiece feeding apparatus 10 mounted on a table 12 adjacent to which induction heating equipment 14 is supported. The induction heating equipment includes an inductor coil 16 through which a workpiece to be heat treated is fed in a manner set forth more fully hereinafter. It will be appreciated, of course, that induction heating equipment 14 includes a power supply for energizing inductor coil 16 for the latter to inductively heat a workpiece passing therethrough. A quenching ring 18 is positioned adjacent inductor coil 16 and is provided with inlet lines 20 by which a suitable quenching fluid is introduced into the ring for flow therefrom through openings 20*a*, as seen in FIG. 3. The quenching fluid of course flows onto the outer surface of a heated workpiece passing through ring 18 to quench the workpiece. The construction and operation of induction heating apparatus and such a quenching ring for the respective heating and quenching functions is well within the skill of the art and need not be further described in detail herein to enable an understanding of the present invention.

Workpiece feeding apparatus 10 is adapted to rotate and axially feed an elongated workpiece W along a path having an axis P which passes through inductor coil 16. For this purpose, the feeding apparatus includes a pair of workpiece supporting assemblies 22 and 24 on opposite sides of inductor 16, and a reciprocable push rod 26 coaxial with axis P and reciprocable in axially opposite directions such as by means of a pneumatic or hydraulic piston and cylinder type motor 28. As explained more fully hereinafter, pusher rod 26 is adapted to push workpiece W into a passageway extending through workpiece supporting assembly 22 and, simultaneously with such pushing movements, assembly 22 is adapted to impart rotation to the workpiece so that the latter is simultaneously rotated and axially advanced through inductor coil 16 and at least partially through a similar passageway extending through workpiece supporting assembly 24. Workpiece supporting assembly 24 is also adapted to impart rotation to the workpiece while the latter is advanced therethrough, and the stroke of pusher rod 26 is sufficient to provide for the trailing end of the workpiece to be advanced into the inlet end of the passageway through assembly 24.

The passageways through workpiece supporting assemblies 22 and 24 are coaxial with axis P. After a workpiece is advanced into workpiece supporting assembly 24, pusher rod 26 returns to the position shown in FIG. 1. Another workpiece is then delivered into the position of workpiece W shown in FIG. 1 so as to be advanced through the workpiece passageways of assemblies 22 and 24 upon the subsequent stroke of pusher rod 26. A workpiece supporting trough T is suitably fixed relative to table 12 in alignment with axis P and serves to guide workpieces W and pusher rod 26 during movement thereof toward workpiece supporting assemblies 22 and 24. Workpieces can be positioned in trough T in any suitable manner. In the embodiment shown, workpieces are delivered onto a supporting surface 30 from a suitable supply trough 32. The workpieces are then pushed along surface 30 toward trough T by means of a reciprocable pusher bar 34 driven by means of a pneumatic piston and cylinder type motor 36. Surface 30 is positioned at or above the edge of trough T so that the workpieces drop thereinto from surface 30.

Workpiece supporting assemblies 22 and 24 are functionally identical and are structurally alike except for the locations of the input shafts of the assemblies. Accordingly, like numerals are employed in the drawings to represent like component parts of the two workpiece supporting assemblies. With reference first to FIGS. 1 and 2 of the drawing, workpiece supporting assemblies 22 and 24 include gear reduction units having corresponding input shafts 38 and corresponding output shafts 40. Output shafts 40 are in the form of sleeves rotatably supported by and extending through the housing of the corresponding gear reduction unit, as set forth more fully hereinafter. Input shafts 38 are disposed on axially opposite sides of the two gear reduction units to facilitate the positioning of inductor coil 16 between assemblies 22 and 24, and the input shafts are driven in unison by means of a drive shaft 42 and belt and pulley assemblies 44. Drive shaft 42 is mounted on and supported by table 12 and is adapted to be driven by a variable speed electric motor 46 having an output shaft coupled to shaft 42.

Figure 4:
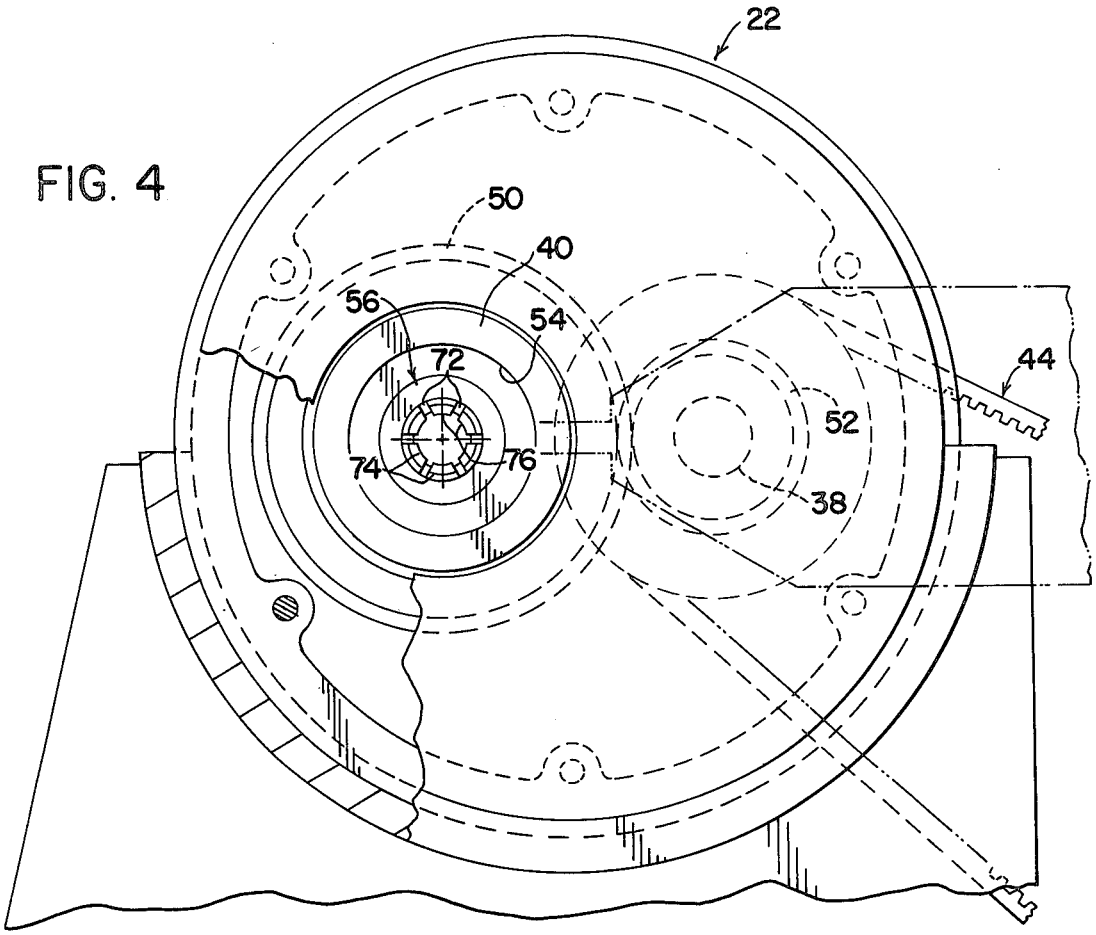
FIG. 4 is an elevation view taken along line 4—4 in FIG. 3.

With reference now to FIGS. 3 and 4 of the drawing, it will be seen that output shafts 40 of assemblies 22 and 24 are in the form of sleeves extending through the opposed walls of the corresponding housing. The sleeve shafts are supported for rotation relative to the housings by means of bearing assemblies 48. It will be further seen that each of the sleeves 40 includes a gear 50 integral therewith and disposed in meshing engagement with a gear 52 mounted on the corresponding input shaft 38. Accordingly, rotation of input shafts 38 imparts rotation to sleeves 40 in the same direction and at a lower rotational speed than that of input shafts 38. Each sleeve 40 includes a radially stepped opening 54 extending therethrough, and a workpiece supporting metal collect 56 is removably mounted in each of the openings 54 for rotation with the corresponding sleeve 40. More particularly in this respect, collets 56 include a body portion received in the smaller diameter portion of opening 54 and having a radially extending pin 60 projecting outwardly into a recess 62 opening axially into the upstream end of sleeve 40. Pin 60 and recess 62 cooperate to axially position collet 56 in opening 54 and to interengage the collet with sleeve 40 for rotation therewith. A set screw 64 extends radially through sleeve 40 into engagement with body portion 58 of the collet to releaseably hold the collet against axial separation from sleeve 40.

Collet 56 is centrally bored to provide a workpiece receiving passageway extending therethrough. The latter passageway includes a radially outwardly flared input end 66, a portion 68 of a first diameter extending forwardly from portion 68, and a portion 70 extending forwardly from portion 68 and of a diameter less than that of portion 68. Collet 56 is further provided with a plurality of axially extending and circumferentially spaced apart slots 72 which extend from the downstream end of the collet about half way toward the upstream end thereof. Slots 72 provide the collet with a plurality of axially extending circumferentially adjacent radially resilient fingers 74 which extend through passageway portion 70 and partially through passageway portion 68. Accordingly, it will be appreciated that the downstream ends of fingers 74 are stepped radially inwardly with respect to passageway portion 68. These portions of fingers 74 provide radially inwardly disposed workpiece engaging surfaces 76 which serve the purpose set forth hereinafter.

It will be noted that the upstream ends of fingers 74 are radially thin, and it will be appreciated that this together with slots 72 provide for fingers 74 to be radially outwardly displaceable from the positions shown in FIG. 3 against the inherent bias of the metal collet material to return the fingers to the positions shown in FIG. 3. Therefore, it will be further appreciated that a workpiece having a diameter equal to or greater than that of passageway portion 70 will be frictionally engaged by finger surfaces 76 and thus rotated thereby in response to rotation of sleeve 40. Still further, it will be appreciated that collet 56 will accommodate workpiece diameters between the diameter of passageway portion 68 and the diameter of passageway portion 70, or workpieces having different diameters along the length thereof and within the latter diameter range. In this respect, a change in diameter relationship along the length of a workpiece will cause fingers 74 to be displaced radially in accordance with the radial direction of such diameter change. This will be better understood with reference to FIG. 5 of the drawing.

Figure 5:
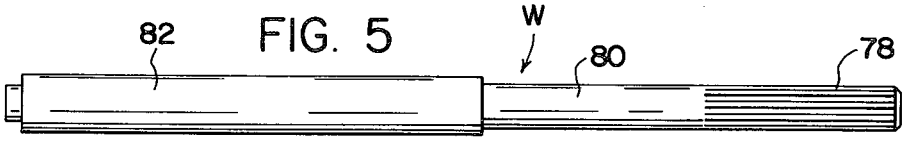
FIG. 5 illustrates an example of a workpiece adapted to be handled by the apparatus of the present invention; and, FIG. 6 is a detailed sectional plan view similar to FIG. 3 and illustrating a workpiece in the feed mechanism.

FIG. 5 illustrates a workpiece W adapted to be handled by the feeding apparatus of the present invention. Either end of workpiece W could be the leading end with respect to the direction of feed by the apparatus and, in the embodiment shown, splined end 78 is the leading end and provides the workpiece with a non-circular cross section along a portion of the length thereof. Portion 80 of the workpiece is of circular cross-sectional configuration, and portions 78 and 80 are of a diameter less than the diameter of passageway portion 68 of the collet and equal to or greater than the diameter of passageway portion 70 of the collet. Portion 82 of workpiece W is circular in cross-sectional configuration and is of a diameter greater than that of portions 78 and 80 and no greater than that which will allow portion 82 to slide through passageway portion 68 of collet 56.

Figure 6:
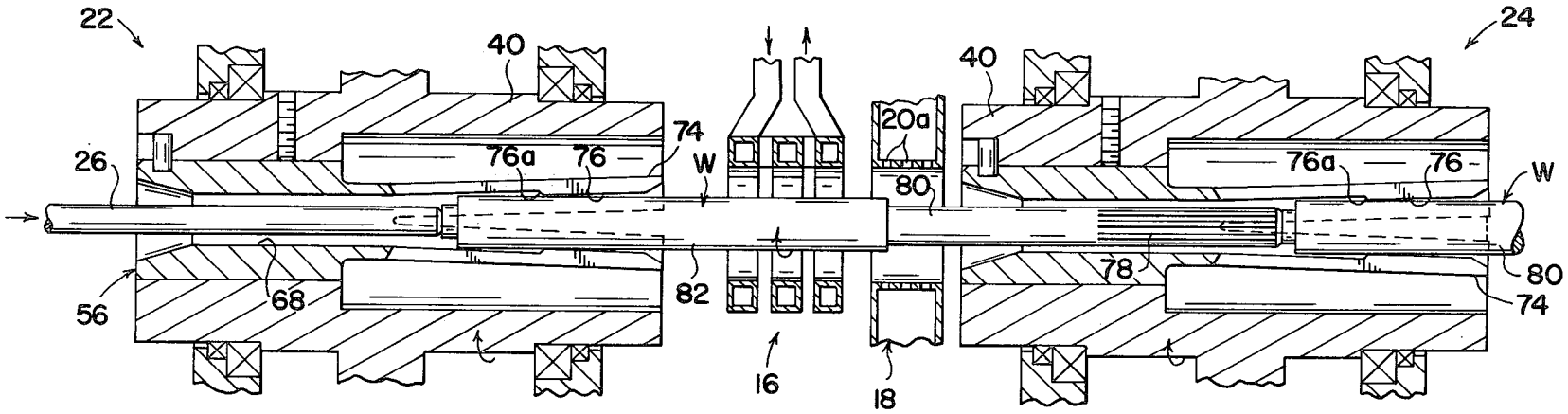

FIG. 6 illustrates workpieces W of the structure shown in FIG. 5 being pushed through the collets of workpiece support assemblies 22 and 24, and thus through inductor coil 16 and quench ring 18. As mentioned hereinabove, axial displacement of the workpiece to the right in FIG. 6 is achieved by pusher rod 26 and, simultaneous with advancement of the workpiece by the pusher rod, sleeves 40 are rotated to rotate collets 56 and thus workpiece W through engagement thereof with surfaces 76 of fingers 74. It will be appreciated from FIG. 6 that as the leading end of the workpiece is moved into and through the passageway of the collet of workpiece support assembly 22, the leading end engages tapered surfaces **76*a* of fingers 74 and the force applied by pusher rod 26 causes the fingers to be displaced radially outwardly for the workpiece to pass between finger surfaces 76. Rotation of the workpiece begins at this time and continues throughout the remainder of the feeding operation. In this respect, as pusher rod 26 displaces workpiece W through the collet of workpiece support assembly 22 and into the collet of workpiece support assembly 24, the workpiece engaging surfaces 76 of fingers 74 of the latter collet engage and rotate the workpiece. Accordingly, rotation of the workpiece continues when the pusher rod has displaced the trailing end of the workpiece from the collet of assembly 22**.

As mentioned hereinabove, the stroke of pusher rod 26 is sufficient to at least displace the trailing end of a workpiece into the entrance end of the collet of assembly 24. Accordingly, it will be appreciated that the next workpiece displaced through the collet of assembly 22 subsequently engages the trailing end of the workpiece in the collet of assembly 24, as seen in FIG. 6, to displace the latter workpiece from the collet. With further regard to FIG. 6, it will be appreciated that the radial shoulder between workpiece portions 80 and 82 engages tapered surfaces **76*a* of fingers 74 during movement of the workpiece through the collets of the workpiece supporting assemblies. As with the leading end of the workpiece, engagement of the radial shoulder with inclined surfaces 76*a* displaces fingers 74 radially outwardly against the inherent radial inward bias thereof and to the positions shown in FIG. 6. Accordingly, it will be appreciated that the workpiece feeding mechanism accommodates workpieces having varying diameters along the length thereof and will also accommodate workpieces having either the diameter of portion 80 or 82 along the entire length thereof. Workpiece W shown in FIG. 5 is merely one example of such workpieces. It will be appreciated too that the removability of collets 56 with respect to sleeves 40 advantageously enables collets having different diameter passageways therethrough to be mounted in sleeves 40**. Thus, by changing collets, the feeding apparatus can accommodate workpieces having diameters which would be outside the range of diameters which can be accommodated by a given size collet passageway.

In the embodiment shown, it will be appreciated that workpiece W is simultaneously rotated and axially advanced through inductor coil 16 and quenching ring 18 such that the workpiece is heat treated during the feeding operation. Therefore, it will be understood that the rate of rotation and axial displacement can be adjusted in accordance with the workpiece configuration, the workpiece material and the heat treating requirements with regard thereto. In this respect, it will be appreciated that the speed of variable speed motor 46 through which sleeves 40 are rotated can be varied together with the rate of feed by push rod 26 to vary the heat treating procedure with regard to a given workpiece. Moreover, it will be appreciated that the stroke of push rod 26 is controlled for the push rod to be returned to the workpiece receiving position thereof immediately following movement of the trailing end of one workpiece into the support assembly 24. For this purpose, as seen in FIG. 1, a limit switch 84 in the path of movement of a limit switch actuator 86 on push rod 26 is actuated when the push rod has displaced the trailing end of a workpiece W into assembly 24. Limit switch 84 operates to control motor 28 to stop further movement of the push rod in the direction of advancement and to cause the push rod to be returned toward its initial position. At the latter position, actuator 86 engages a limit switch 88 to stop the return movement, whereupon a new workpiece is moved into trough T for advancement through assemblies 22 and 24. Control of the push rod in this manner through the use of limit switches is well within the skill of the art and is not necessary to an understanding of the present invention, whereby the control components are not illustrated.

Preferably, energization and de-energization of inductor coil 16 is controlled in coordination with displacement of push rod 26 so that the inductor coil is de-energized during the period of return movement of push rod 26 and the initial portion of advancing movement thereof necessary to position the leading end of the workpiece adjacent the entrance end of the inductor coil. For this purpose, as shown in FIG. 1 of the drawing, a pair of limit switches 90 and 92 are positioned between limit switches 84 and 88 and in the path of movement of limit switch actuator 86 on push rod 26. In the positions of the component parts shown in FIG. 1, inductor coil 16 would be de-energized. During advancement of push rod 26 to the right in FIG. 1 to push workpiece W toward support assembly 22, limit switch actuator 86 would engage limit switch 90 to energize inductor coil 16 just before the leading end of workpiece W reaches the entrance end of the inductor coil.

During continued movement of push rod 26 in the direction of advancement, limit switch actuator 86 engages limit switch 92 to deenergize inductor coil 16 as the trailing end of workpiece W passes the exit end of coil 16. Limit switch actuator 86 would then engage limit switch 84 as described hereinabove to achieve return movement of push rod 26 and, during such movement, limit switches 90 and 92 would be displaced to inoperable positions by engagement of actuator 86 therewith so that inductor coil 16 would remain deenergized. Electrical circuitry for controlling inductor coil 16 in this manner through the use of limit switches is well within the skill of the art and is not necessary to an understanding of the present invention. Accordingly, such circuitry is not illustrated.

While considerable emphasis has been placed on the preferred embodiment herein illustrated and described, it will be appreciated that many changes can be made therein without departing from the principles of the present invention. In this respect, for example, components or structures other than a collet could be employed to engage and rotate a workpiece being advanced therethrough. For example, the workpiece engaging surfaces could be defined by fingers or other elements pivotally mounted on a supporting body and biased radially inwardly for engagement with the workpiece by suitable biasing spring arrangements. Still further, arrangements other than gear reduction units could readily be devised and employed to support and rotate the mandrel or an equivalent component or structure serving the same purpose as the mandrel. Many embodiments of the present invention can be made and many changes can be made in the embodiment herein illustrated and described and, accordingly, it is to be distinctly understood that the foregoing descriptive matter is to be interpreted merely as illustrative of the present invention and not as a limitation.

Having thus described the invention, it is claimed:

1. Apparatus for rotating and axially feeding an elongated varying diameter workpiece in a given direction along a path comprising, axially fixed rotatable collet means having axially extending radially inwardly and outwardly displaceable finger means, said collet means having a free radially variable workpiece receiving passageway therethrough defined by said finger means, said finger means being biased to continuously radially engage and slidably support a workpiece of varying diameter received in said passageway, means to continuously rotate said collet means for a workpiece in defined by said passageway to be continuously rotated by said finger means, and pusher means separate from said means to rotate said collect means to move said workpiece through said passageway in said given direction and relative to said rotating finger means.

2. Apparatus for rotating and axially feeding an elongated varying diameter workpiece in a given direction along a path comprising, axially fixed rotatable workpiece supporting means having a workpiece receiving passageway therethrough including workpiece surface engaging means biased to continuously radially engage and slidably support a workpiece received in said passageway, means to continuously rotate said workpiece supporting means for a workpiece in said passageway to be continuously rotated by said workpiece surface engaging means, means separate from said surface engaging means to move said workpiece through said passageway in said given direction and relative to said rotating surface engaging means, said workpiece supporting means being collet means having axially extending radially displaceable finger means defining said workpiece surface engaging means, said means to rotate said workpiece supporting means including rotatable sleeve means having an opening therethrough coaxial with said path, said collet means being removably mounted in said opening for rotation with said sleeve means, said finger means being displacable radially inwardly and outwardly relative to said sleeve means for said workpiece receiving passageway to be freely radially variable and means to rotate said sleeve means.

3. Apparatus according to claim 1, wherein said means to move a workpiece through said passageway includes a reciprocable pusher rod, and means to reciprocate said pusher rod.

4. Apparatus for rotating and axially feeding an elongated varying diameter workpiece in a given direction along a path comprising, axially fixed rotatable workpiece supporting means having a workpiece receiving passageway therethrough including workpiece surface engaging means biased to continuously radially engage and slidably support a workpiece received in said passageway, means to continuously rotate said workpiece supporting means for a workpiece in said passageway to be continuously rotated by said workpiece surface engaging means, means separate from said surface engaging means to move said workpiece through said passageway in said given direction and relative to said rotating surface engaging means, said means to move a workpiece through said passageway including a reciprocable pusher rod, means to reciprocate said pusher rod, said workpiece support means being collet means having axially extending radially displaceble finger means defining said workpiece surface engaging means, said means to rotate said workpiece supporting means including rotatable sleeve means having an opening therethrough coaxial with said path, said collet means being removably mounted in said opening for rotation with said sleeve means, said finger means being displacable radially inwardly and outwardly relative to said sleeve means for said workpiece receiving passageway to be freely radially variable and means to rotate said sleeve means.

5. Apparatus for rotating and axially feeding an elongated workpiece in a given direction along a path comprising, axially fixed rotatable workpiece supporting means having a workpiece receiving passageway therethrough including workpiece surface engaging means biased to continuously radially engage and slidably support a workpiece received in said passageway, means to continuously rotate said workpiece supporting means for a workpiece in said passageway to be continuously rotated by said workpiece surface engaging means, means separate from said surface engaging means to move said workpiece through said passageway in said given direction and relative to said rotating surface engaging means, and second workpiece supporting means spaced from said first named workpiece supporting means in said given direction and a distance less than the length of said workpiece, said second workpiece supporting means being identical to said first named workpiece supporting means, means to continuously rotate said second workpiece supporting means, and said means to move said workpiece being operable to move said workpiece at least partially through the passageway of said second workpiece supporting means.

6. Apparatus according to claim 5, wherein each said first named and second workpiece supporting means is collet means having axially extending radially displaceable finger means defining the corresponding workpiece surface engaging means.

7. Apparatus according to claim 6, wherein said means to rotate said first named and said second workpiece supporting means includes corresponding rotatable sleeve means having openings therethrough coaxial with said path, said collet means of each said first named and second workpiece supporting means being removably mounted in the opening of the corresponding sleeve means for rotation therewith, and means to rotate each said sleeve means.

8. Apparatus according to claim 7, wherein said means to move said workpiece is a reciprocable pusher rod, and means to reciprocate said pusher rod.

* * * * *